US011591173B2

(12) United States Patent
Hatakawa

(10) Patent No.: US 11,591,173 B2
(45) Date of Patent: Feb. 28, 2023

(54) SHEET STORAGE APPARATUS

(71) Applicant: Kazunori Hatakawa, Yamanashi-ken (JP)

(72) Inventor: Kazunori Hatakawa, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/363,420

(22) Filed: Jun. 30, 2021

(65) Prior Publication Data

US 2021/0403260 A1 Dec. 30, 2021

(30) Foreign Application Priority Data

Jun. 30, 2020 (JP) ..... JP2020-112394

(51) Int. Cl.
*B65H 3/14* (2006.01)

(52) U.S. Cl.
CPC ..... *B65H 3/14* (2013.01)

(58) Field of Classification Search
CPC ... B65H 3/14; B65H 3/48; B65H 3/50; B65H 3/54; B65H 3/56; B65H 2405/11425; B65H 2701/1315
USPC ..... 271/31, 97, 104, 123, 124
See application file for complete search history.

(56) References Cited

U.S. PATENT DOCUMENTS

| | | | | |
|---|---|---|---|---|
| 7,677,553 | B2 * | 3/2010 | Ikeda | B65H 3/48 271/97 |
| 8,141,864 | B2 * | 3/2012 | Fukumoto | B65H 3/56 271/97 |
| 8,186,668 | B2 * | 5/2012 | Wardak | B65H 3/48 271/97 |
| 8,870,179 | B2 * | 10/2014 | Shiraishi | B65H 3/08 271/31 |
| 9,725,265 | B2 * | 8/2017 | Hashimoto | B65H 1/14 |

FOREIGN PATENT DOCUMENTS

| | | |
|---|---|---|
| JP | 2011-236058 A | 11/2011 |
| JP | 2016-113269 A | 6/2016 |

* cited by examiner

*Primary Examiner* — Gregory W Adams
(74) *Attorney, Agent, or Firm* — Manabu Kanesaka

(57) ABSTRACT

To reduce, at the time of sheet replenishment, breakage of a floating regulation member that regulates floating of a sheet floated by air blowing in a sheet storage apparatus that loosen stored sheets by means of air blowing. Air is blown to sheets stored in a storage part to loosen the sheets. One of a pair of side regulation members for regulating both ends of the sheets stored in the storage part has a floating regulation member for regulating floating of a sheet floated by means of air blowing. The floating regulation member is configured to be turnable in a sheet stacking direction about a rotation axis provided to one of the side regulation members on the side at which the floating regulation member is provided. A load applied to the floating regulation member differs between when the floating regulation member is turned upward and when it is turned downward.

4 Claims, 8 Drawing Sheets

SHEET STORAGE APPARATUS

FIELD OF THE INVENTION

The present invention relates to a sheet storage apparatus for storing sheets to be fed to an image forming apparatus and, more particularly, to a sheet storage apparatus configured to blow air to stacked sheets to separate the sheets one from another and feed them one by one.

BACKGROUND ART

Image forming apparatuses, such as copying machines and printer, are configured to take out sheets one by one from a deck storing stacked sheets while separating them one from another, perform image forming processing for the sheet, and then discharge the image-formed sheet. However, when adhesion between the stacked sheets in the deck is high, separability between the sheets deteriorates. As a result, a multi-feed (phenomenon where two or more sheets are fed simultaneously in an overlapping manner) and a feeding failure (sheet conveyance delay, etc.) are more apt to occur in the course of sheet feeding from the deck. In particular, under a high humidity environment, the sheets highly adhere to each other to make the multi-feed and feeding failure more likely to occur.

In order to cope with the above problem, there is proposed a method that blows air to the end portions of the sheets stored in the deck so as to make the air flow between the sheets, thereby floating the sheet for easy separation of the sheets. However, when the air blowing pressure is high, the sheets may be blown, or the sheets may adhere to each other once again due to a negative pressure generated when the air enters between the once separated sheets.

In view of this, for example, Japanese Patent Application Publication No. 2011-236058 (Patent Document 1) proposes an apparatus which is configured to loosen stored sheets one from another by air blowing and feeds them and which has a floating height regulation member that regulates the floating height of the sheet by abutting against the topmost surface of the stacked sheets floated by the air blowing.

Further, for example, Japanese Patent Application Publication No. 2016-113269 (Patent Document 2) proposes a configuration provided with a stopper member, which has a fixed canopy structure, for regulating sheets being floated by air blowing.

PRIOR ART DOCUMENT

Patent Document

[Patent Document 1] Japanese Patent Application Publication No. 2011-236058

[Patent Document 2] Japanese Patent Application Publication No. 2016-113269

DISCLOSURE OF INVENTION

Problems to be Solved by the Invention

However, when any one of such floating regulation members as disclosed in JP 2011-236058A and JP 2016-113269A is provided, it may interfere with a sheet replenishing operation or a sheet removing operation. Further, in this case, when a sheet bundle or a foreign matter is left behind in a storage part and is forcibly moved for removal, the floating regulation member may be broken, or the sheets may be damaged.

The present invention has been made in view of such problems posed in the conventional technique and an object thereof is to provide a sheet storage apparatus having good sheet loosening performance and user operability while reducing breakage of the floating regulation member.

Means for Solving the Problem

To solve the above problems, a sheet storage apparatus according to a first aspect of the present invention includes: a storage part for storing sheets; a pair of first and second side regulation members for regulating both end portions of the sheets stored in the storage part; a sheet feed part for conveying the sheets stored in the storage part in a predetermined conveyance direction; a blower unit provided to the first side regulation member and configured to blow air to one ends of the sheets stored in the storage part to loosen the sheets; and a floating regulation member provided to the first side regulation member and configured to regulate the height of the sheet floated by the air fed by the blower unit, wherein the floating regulation member is provided so as to be turnable in a sheet stacking direction about a rotation axis provided to the first side regulation member, and a load applied to the floating regulation member differs between when the floating regulation member is turned upward and when it is turned downward.

In one embodiment of the present invention, the sheet storage apparatus further includes: an elastic member for defining the position of the floating regulation member in its turning direction; and a turning regulation guide for regulating the position of the floating regulation member. When the floating regulation member is turned downward, it is held by a holding force of the elastic member, and when the floating regulation member is turned upward, the upward turning of the floating regulation member is regulated by the turning regulation guide together with the elastic member until a predetermined load is applied. That is, a load applied to the floating regulation member differs between when the floating regulation member is turned upward and when it is turned downward.

The turning regulation guide has a slope part contacting the floating regulation member, and when the floating regulation member is turned upward to cause an overload, the floating regulation member is slid along the slope part in the conveyance direction. Thus, when the floating regulation member is applied with a large load in the upward turning direction, it can be retracted along the slope part and can thus be prevented from breakage.

To solve the above problems, a sheet storage apparatus according to a second aspect of the present invention includes: a storage part for storing sheets; a pair of first and second side regulation members for regulating both end portions of the sheets stored in the storage part; a sheet feed part for conveying the sheets stored in the storage part in a predetermined conveyance direction; a blower unit provided to the first side regulation member and configured to blowing air to one ends of the sheets stored in the storage part to loosen the sheets; and floating regulation members provided respectively to the first and second side regulation members and configured to regulate the height of the sheet floated by the air fed by the blower unit, wherein the floating regulation members are provided on an apparatus far side and an apparatus near side of the storage part so as to be turnable in a sheet stacking direction about rotation axes provided respectively on the first and second side regulation members, and a load applied to the floating regulation member when the floating regulation member is turned upward is different between the floating regulation member on the far side and floating regulation member on the near side.

According to the present invention, a sheet loosened by air blowing can be reliably held in the floating upper limit position, and resistance by the floating regulation member is small at the time of sheet replenishment, thus improving user operability.

MODE FOR CARRYING OUT THE INVENTION

Hereinafter, a specific embodiment of the present invention will be described in detail with reference to the drawings.

[Image Forming System]

Figure 1:
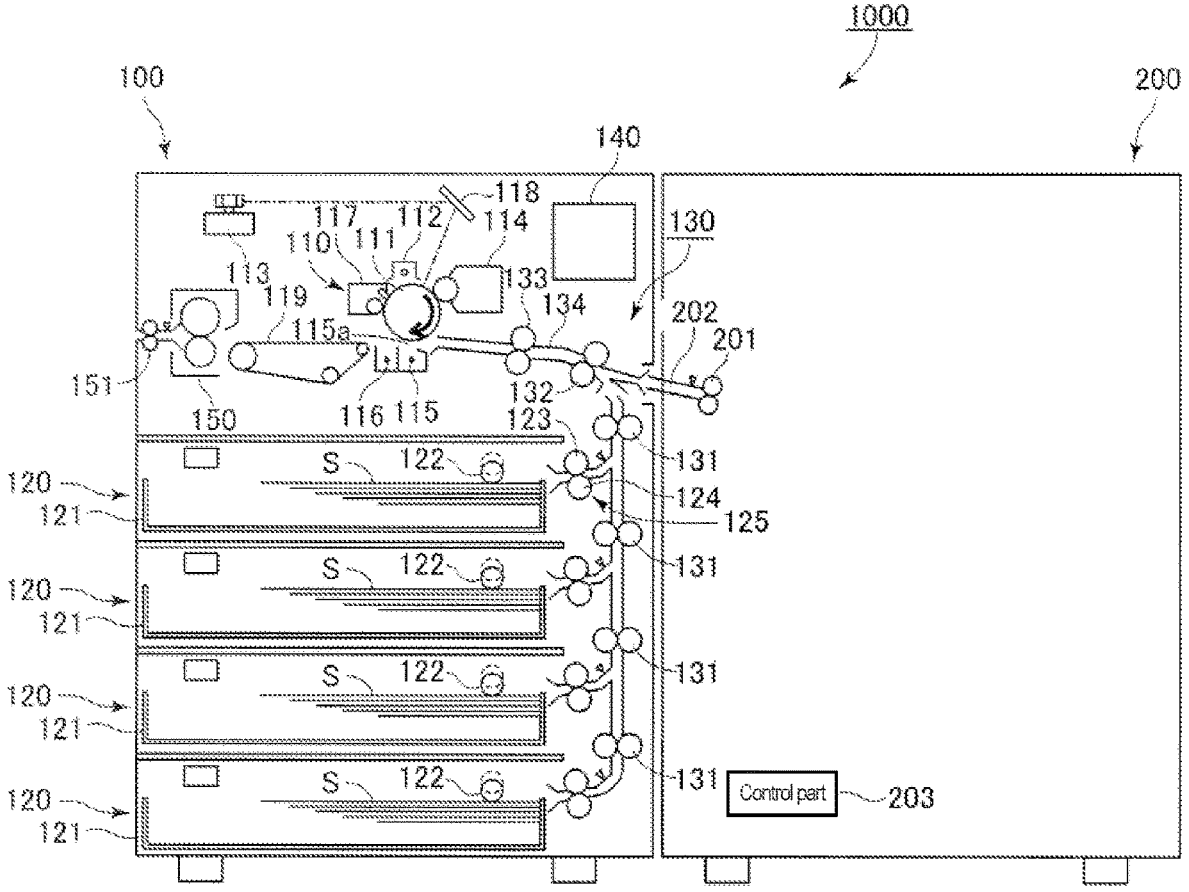
FIG. 1 is a cross-sectional view schematically illustrating the configuration of an image forming system according to an embodiment.
Figure 2:
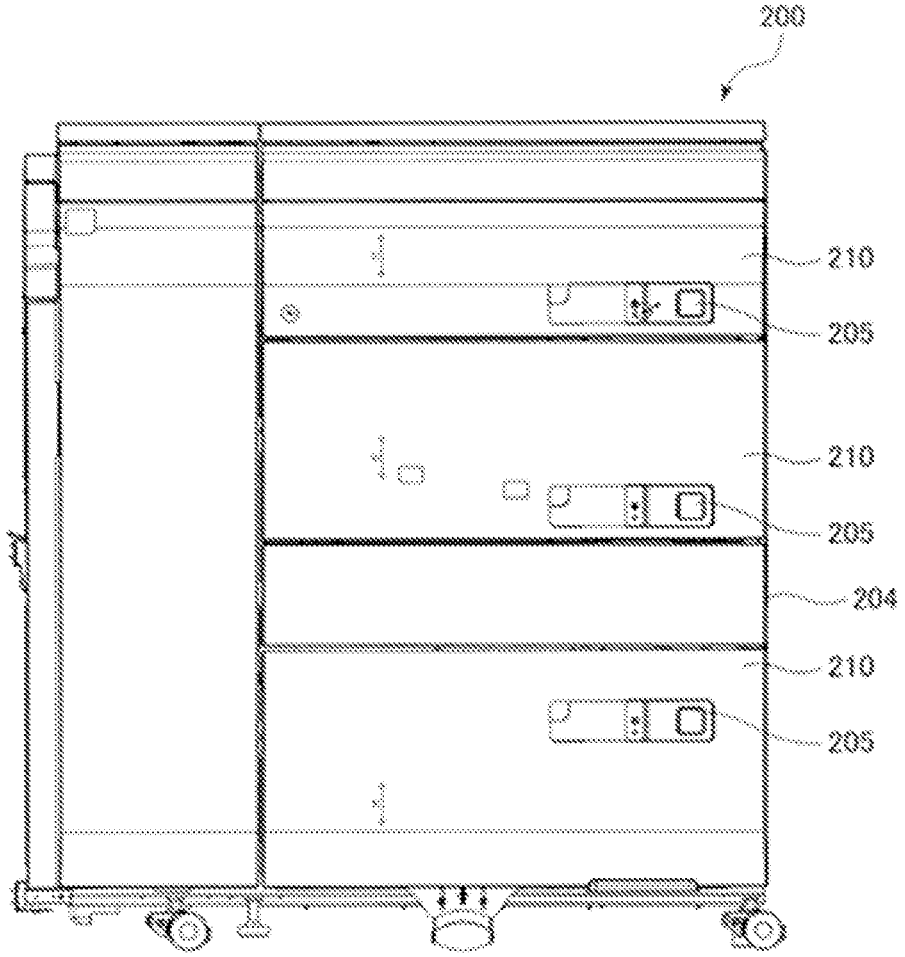
FIG. 2 is a front view of a multi-stage deck according to the embodiment.

FIG. 1 is a cross-sectional view schematically illustrating an example of an image forming system provided with a multi-stage deck according to the present embodiment and an image forming apparatus. In the following description, an electrophotographic laser printer system (hereinafter, referred to merely as "printer") is taken as an example of an image forming apparatus provided with an image forming part. The image forming apparatus constituting the image forming system may be apparatuses other than the printer, such as a copying machine, a facsimile, and a multifunction machine. Further, the image forming apparatus is not limited to of an electrophotographic type, but may be of other types such as an inkjet system.

An image forming system 1000 according to the present embodiment has an image forming apparatus 100, and a multi-stage deck 200 as a sheet storage apparatus connected to the image forming apparatus 100. Although details will be described later, the multi-stage deck 200 has a plurality of storage cases each capable of storing a plurality of sheets, and the sheets can be fed from each of the storage cases to the image forming apparatus 100. Examples of the sheet include a paper sheet such as plain paper, thin paper, or a cardboard, and a plastic sheet.

The image forming apparatus 100 forms a toner image on a sheet according to an image signal from a document reading apparatus (not illustrated) connected to an image forming apparatus body or a host device such as a personal computer communicably connected to the image forming apparatus body.

The image forming apparatus 100 has an image forming part 110, a plurality of sheet storage units 120, a sheet conveying unit 130, and other components. The components of the image forming apparatus 100 are each controlled by a control part 140. The control part 140 has a CPU (Central Processing Unit), a ROM (Read Only Memory), and a RAM (Random Access Memory). The CPU controls the components while reading a program corresponding to a control procedure stored in the ROM. The RAM stores therein work data or input data, and the CPU performs control according to the above-mentioned program while referring to the above data stored in the RAM.

The plurality of sheet storage units 120 each have a cassette 121 for storing sheets S, a pickup roller 122, and a separating and conveying roller pair 125 constituted of a feeding roller 123 and a retard roller 124. The sheets S stored in the cassette 121 are fed one by one by the pickup roller 122 rotating while moving up and down at a predetermined timing and a separating and conveying roller pair 125.

The sheet conveying unit 130 has a conveying roller pair 131, a pre-registration roller pair 132, and a resist roller pair 133. The sheet S fed from the sheet storage unit 120 is made to pass through a sheet conveyance path 134 by the conveying roller pair 131 and pre-registration roller pair 132 and is guided to the resist roller pair 133. Then, the sheet S is fed to the image forming part 110 at a predetermined timing by the registration roller pair 133.

A sheet conveyed from the multi-stage deck 200 to be described later through a conveying roller pair 201 is then conveyed to the image forming apparatus 100 through a connection path 202 connecting to the image forming apparatus 100. Like the sheet conveyed from the sheet storage unit 120 in the image forming apparatus 100, the sheet conveyed from the multi-stage deck 200 to the image forming apparatus 100 is fed to the image forming part 110 through the pre-registration roller pair 132 and registration roller pair 133 at a predetermined timing.

The image forming part 110 has a photosensitive drum 111, a charger 112, a laser scanner 113, a developing unit 114, a transfer charger 115, a separation charger 116, a cleaner 117, and other components. At the time of image formation, the photosensitive drum 111 is driven into rotation in a direction of the arrow in FIG. 1, and the surface of the photosensitive drum 111 is uniformly charged by the charger 112. Then, a laser light that the laser scanner 113 emits according to an image signal is irradiated onto the charged photosensitive drum 111 after being reflected by a mirror 118, whereby an electrostatic latent image is formed on the photosensitive drum 111. The electrostatic latent image thus formed on the photosensitive drum 111 is then visualized as a toner image by the developing unit 114.

Thereafter, the toner image on the photosensitive drum 111 is transferred onto the sheet S by the transfer charger 115 at a transfer part 115*a*. Thereafter, the sheet S onto which the toner image has been transferred is electrostatically separated from the photosensitive drum 111 by the separation charger 116. Toner remaining on the photosensitive drum 111 after the transfer is removed by the cleaner 117. The sheet S onto which the toner image has been transferred is conveyed to a fixing device 150 by a conveying belt 119, where the toner image is fixed. After that, the resultant sheet S is discharged outside the apparatus by a discharge roller 151.

[Multi-Stage Deck]

The following describes the multi-stage deck 200 as the sheet storage apparatus according to the present embodiment. First, with reference to FIGS. 2 to 6, the outline of the multi-stage deck 200 will be described. The multi-stage deck 200 has a plurality of storage cases 210 each serving as a sheet storage capable of storing a plurality of sheets. The storage cases 210 are arranged vertically in a plurality of stages. Each storage case 210 is configured to be withdrawn and inserted from and into a housing 204 of the multi-stage deck 200. The storage cases 210 have basically the same configuration except for the number of storable sheets (the number of storable sheets may be the same thereamong).

A sheet fed from each storage case 210 is conveyed to the connection path 202 (FIG. 1) through a not-shown conveyance path. Components of the multi-stage deck 200 are each controlled by a control part 203 (FIG. 1). Like the above-mentioned control part 140, the control part 203 has a CPU, a ROM, and a RAM. The control part 203 can communicate with the control part 140 of the image forming apparatus 100. By communicating with the control part 140, the control part 203 controls, for example, a sheet feeding timing.

Figure 3:
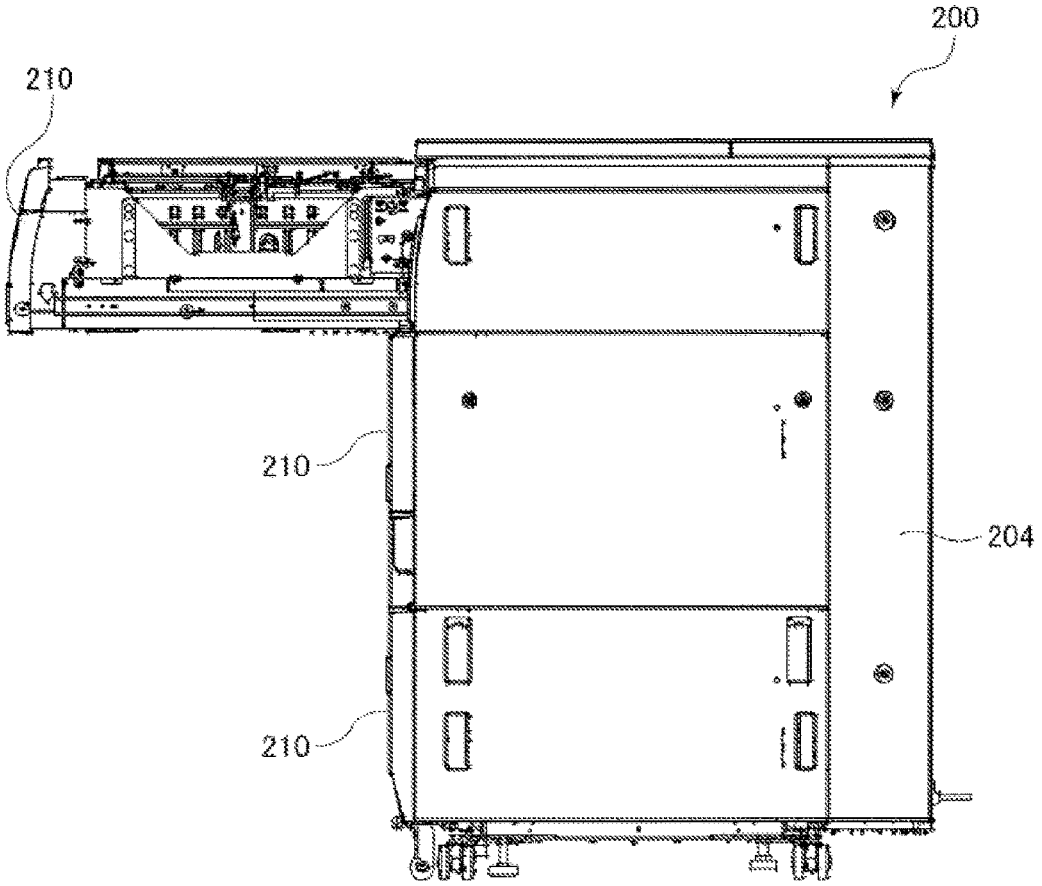
FIG. 3 is a side view of the multi-stage deck according to the embodiment in a state where a storage case is withdrawn.
Figure 4:
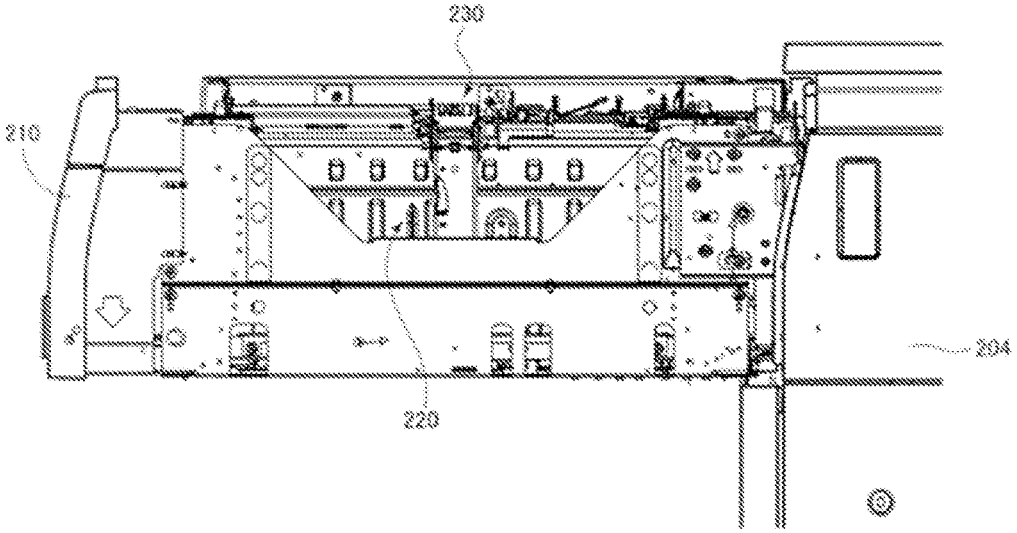
FIG. 4 is an enlarged side view of the multi-stage deck according to the embodiment in a state where a storage case is withdrawn.
Figure 5:
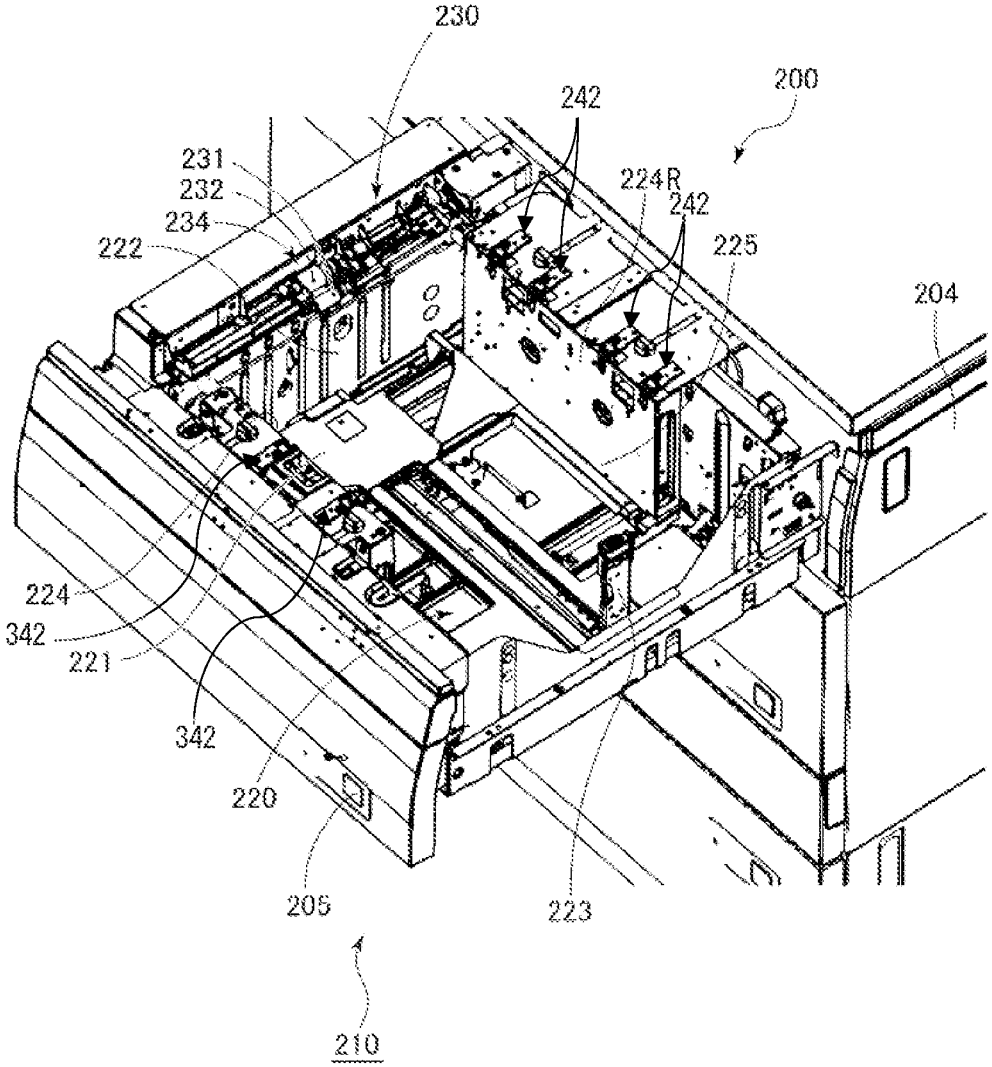
FIG. 5 is an enlarged perspective view of the multi-stage deck according to the embodiment in a state where a storage case is withdrawn.

The multi-stage deck 200 has a button 205 serving as an operation part for withdrawal of the storage case 210. The button 205 is provided on the front surface of each storage case 210. For example, when an operator presses the button 205, a lock mechanism locking the storage case 210 at the attachment position thereof is unlocked, and the storage case 210 is pushed out from the housing 204 by means of a not-shown spring. As a result, the operator can withdraw the storage case 210 to a position allowing sheet storage, as illustrated in FIGS. 3 to 5. A configuration may be adopted in which the press of the button 205 activates a motor or the like to automatically withdraw the storage case 210 to a position allowing sheet storage.

Figure 6:
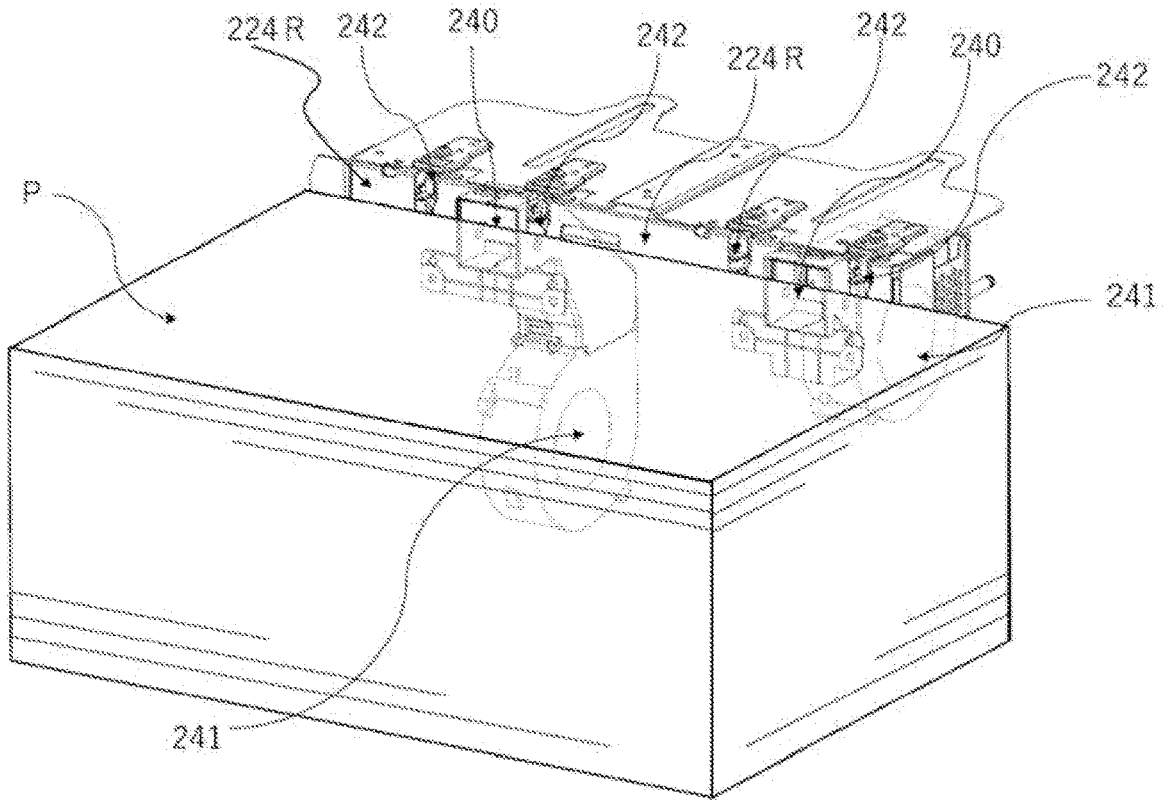
FIG. 6 is an enlarged perspective view illustrating a state where sheets are set in the storage case of the multi-stage deck according to the embodiment.

As illustrated in FIGS. 4 to 6, the storage case 210 has a storage part 220 that stores the sheets S and a sheet feed part 230 that feeds the sheet S from the storage part 220 toward the image forming apparatus 100. As illustrated in FIG. 5, the storage part 220 has a stacking tray 221 in which the sheets S are stacked, a stopping part 222, a rear end regulation plate 223, a side regulation member 224 and the like. The stacking tray 221 is configured to be moved up and down vertically by a not-shown elevating mechanism. The stacking tray 221 is moved down to a predetermined position at the time of storing (stacking) the sheets S and is gradually moved up every time the sheet S is fed out.

The stopping part 222 is disposed at a downstream location in a sheet conveyance direction in a sheet storage space 225 and receives abutment of the downstream ends in the sheet conveyance direction (front ends) of the sheets stacked on the stacking tray 221. The rear end regulation plate 223 is disposed at an upstream location in the sheet conveyance direction in the storage space 225 and receives abutment of the upstream ends in the sheet conveyance direction (rear ends) of the sheets stacked on the stacking tray 221 to regulate the sheet rear end position. The rear end regulation plate 223 can be moved in the sheet conveyance direction, allowing the sheet rear end regulation position to be adjusted in accordance with the sheet size. The side regulation member 224 includes side regulation members 224R and 224F, which are disposed at both sides of the storage space 225 in the width direction perpendicular to the sheet conveyance direction and regulate the width direction both end positions of the sheet. The side regulation members 224 R and 224F can be moved in the width direction, allowing the sheet width direction regulation positions to be adjusted in accordance with the sheet size.

As illustrated in FIG. 6, the side regulation member 224R has, at its upper portion, two blower ports 240. The blower ports 240 are provided for blowing the air fed by blower units 241 provided inside the side regulation member 224R to the side end portions of stacked sheets P. Although two blower ports 240 are provided in the present embodiment, the number of the blower ports 240 is not limited to this.

The blower units 241 are a fan mechanism that feeds air, and the blower ports 240 as an air outlet are formed in the surface of the side regulation member 224R against which the sheets abut. The air fed from the blower unit 241 flows through a blowing passage and exits from the blower ports 240 to be blown to the topmost sheet P and several sheets P positioned below the topmost sheet P. Although two blower units are provided in one storage space in the present embodiment, other various forms may be employed. For example, air driven by one blower unit may be blown through a plurality of blower ports, and three or more blower units may be provided.

A floating regulation member 242 is disposed at four positions above the blower ports 240. The floating regulation member 242 is configured to be turnable about a rotation axis provided to the side regulation member 224 and protrudes above the sheet P so as to regulate floating of the sheet P abutting against the side regulation member 224. With this configuration, the sheet P blown by the air fed through the blower ports 240 and thus be floated abuts against the floating regulation member 242 to be prevented from being floated higher than the position of the floating regulation member 242. Thus, a sufficient amount of air is fed between sheets and, whereby, the sheet P is regulated to an adequate position where it can be separated from the lower sheet and properly fed, thus preventing multi-feed.

Figure 7:
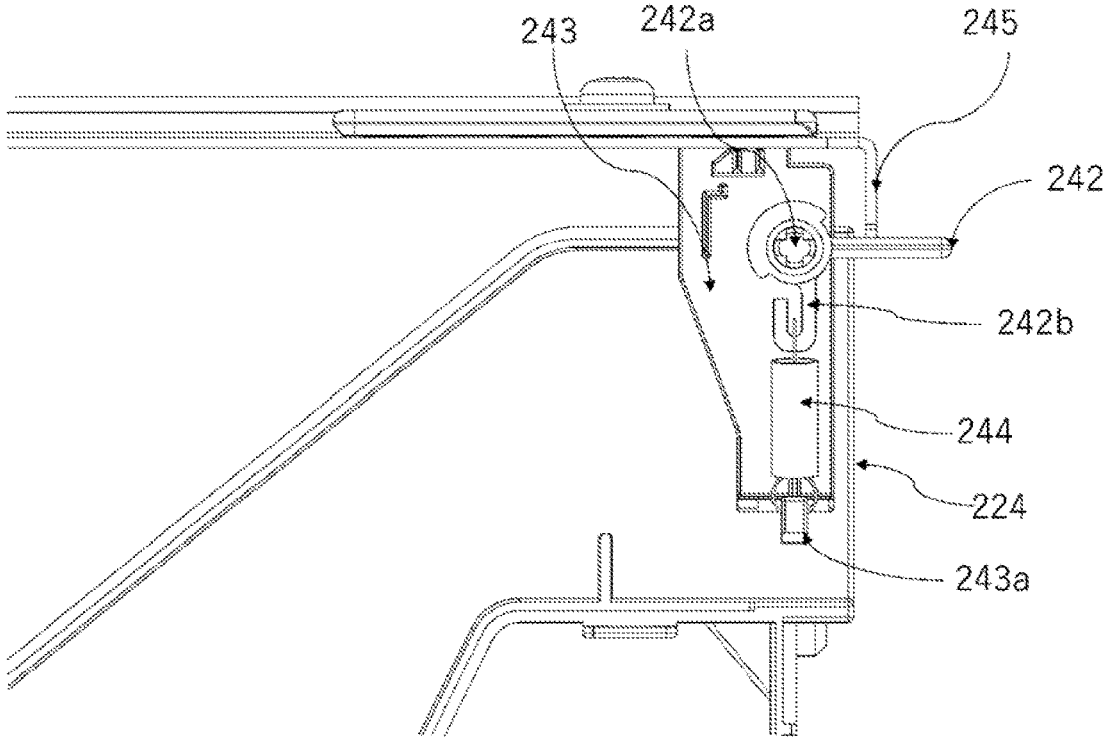
FIG. 7 is a schematic view illustrating an attachment state of a rear-side floating regulation member.

The floating regulation member 242 will be described in more detail. As illustrated in FIG. 7, the floating regulation member 242 is configured to be turnable about a rotation axis 242*a*. The floating regulation member 242 is attached with an elastic member 244 for maintaining the angle of the floating regulation member 242 by pulling the floating regulation member 242 downward of the rotation axis 242*a*. As the elastic member 244, a tension spring is used. One end of the tension spring is attached to an attachment part 242*b* provided immediately below the rotation axis 242*a*, and the other end thereof is attached to an attachment part 243*a* fixed to the side regulation member 224. The floating regulation member 242 rotates clockwise about the rotation axis 242*a* by its own weight in the absence of the elastic member 244. The elastic member 244 applies a tensile force to the floating regulation member 242 to hold the floating regulation member 242 at a floating regulation position as illustrated in FIG. 7.

A turning regulation guide 245, which regulates the upward turning of the floating regulation member 242, is provided above the floating regulation member 242. The floating regulation member 242 is positioned so as to hold the sheet by the force of the elastic member 244. The turning regulation guide 245 serves as a stopper for preventing the floating regulation member 242 from being turned upward by the floating force of the sheet floated by the air driven by the blower unit 241.

Thus, a load applied to the floating regulation member 242 differs between when the floating regulation member 242 is turned upward and when it is turned downward. That is, the floating regulation member 242 is applied with a larger load when being turned upward due to air blowing, so that the sheet blown by the air is reliably stopped at the floating upper limit position. On the other hand, the floating regulation member 242 is applied with a smaller load when being turned downward at the time of replenishing sheets in the storage part 220, thus allowing a user to easily store the sheet.

Figure 8:
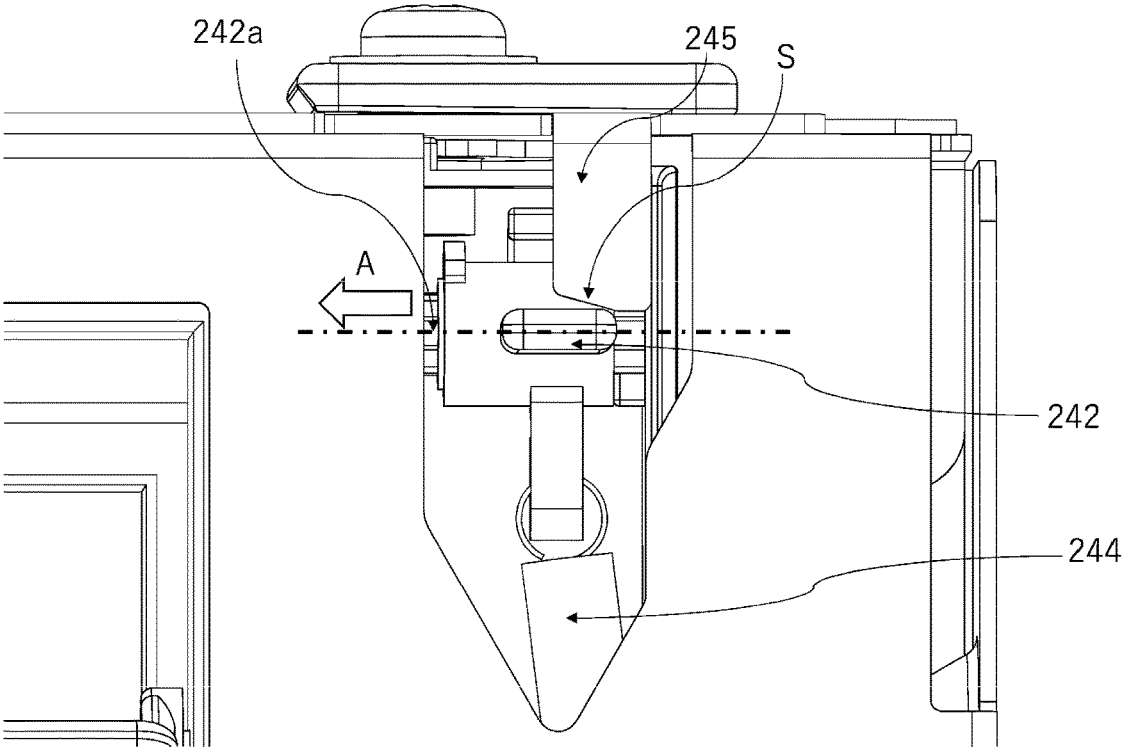
FIG. 8 is an enlarged view illustrating the positional relation between the rear-side floating regulation member and a turning regulation guide.
Figure 9:
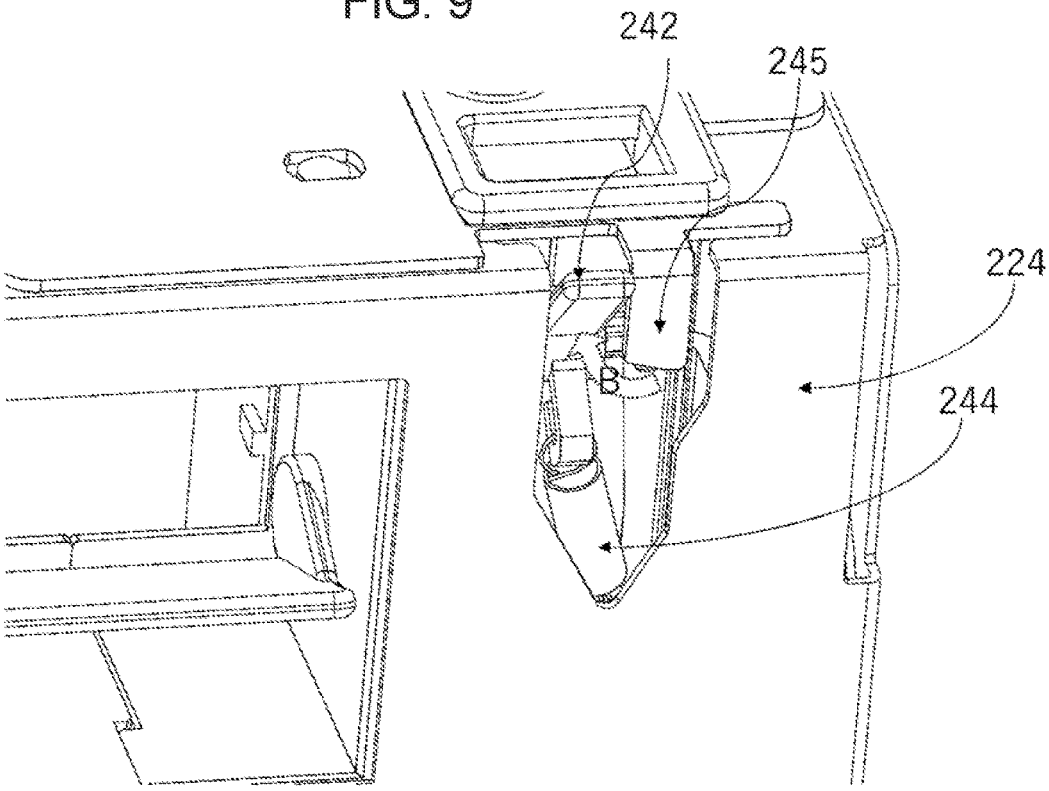
FIG. 9 is a schematic view illustrating a state where an upward force is applied to the rear-side floating regulation member.

The turning regulation guide 245 has a slope part S in the surface thereof against which the floating regulation member 242 abuts. When a user takes out the sheet bundle without widening the space between the front-side side regulation member 224F and the rear-side side regulation member 224R, the sheet bundle pushes the floating regulation member 242 upward, and the floating regulation member 242 pushed upward abuts against the slope part S of the turning regulation guide 245 to be turned upward along the slope. At the same time, the floating regulation member 242 slid along the slop part S in the direction of the arrow A in FIG. 8 to the position illustrated in FIG. 9.

The "front" side mentioned above refers to the near side of the image forming system 1000 as viewed from a user who operates the same, and the "rear" side refers to the far side.

Since the floating regulation member 242 is turned along the slope part S, it is turned with its lifting power at the start of turning kept constant so that the sheet bundle to be taken out is not subjected to pressing by the floating regulation member 242. Thus, the topmost sheet of the sheet bundle and several sheets therebelow have reduced damage, and the floating regulation member 242 itself is prevented from breakage.

The floating regulation member 242 is slid in the sheet conveyance direction, and the rear end regulation plate 223 for regulating the sheet rear end is provided upstream in the sheet conveyance direction. When the sheet bundle is taken out without retracting the rear end regulation plate 223 (although it is generally preferably retracted from the sheet bundle), if the floating regulation member 242 is slid to the rear end side, the topmost sheet moves together with the floating regulation member 242 to abut against the rear end regulation plate 223 and ends up being damaged. To prevent this, in the present embodiment, the floating regulation member 242 is configured to be slid in the sheet conveyance direction (in the direction of the arrow A in FIG. 8), whereby damage to the sheet can be reduced.

Thus, a load applied to the floating regulation member 242 differs between when the floating regulation member 242 is turned upward and when it is turned downward. That is, the floating regulation member 242 is turned downward with a smaller load due to contact with the sheet bundle at the time of replenishing sheets in the storage part 220, allowing a user to easily store the sheets. On the other hand, the floating regulation member 242 is applied with a larger load due to abutment against the turning regulation guide 245 when being turned upward during air blowing by the blower unit 241, so that the sheet blown by the air is reliably stopped at the floating upper limit position.

When the floating regulation member 242 is applied with a large load due to lifting of the sheet bundle by the user at the time of taking out the sheet bundle from the storage part 220, the floating regulation member 242 moves along the slope S of the turning regulation guide 245, so that it is possible to prevent damage to the sheet bundle to be taken out due to strong abutment against the floating regulation member 242. At the time of taking out the sheet, the sheet bundle is taken out with the front side (near side as viewed from the user) thereof lifted. That is, the rear side (floating regulation member 242 side) of the sheet bundle is less apt to be lifted and thus less likely to strongly abut against the floating regulation member 242. Thus, the configuration of moving the floating regulation member 242 along the slope S of the turning regulation guide 245 is a safety measure to prevent breakage of the floating regulation member 242.

In addition to the floating regulation member 242 provided on the rear side (side regulation member 224R side) of the stacking tray 221, a second floating regulation member 342 may be provided on the apparatus front side so as to face the floating regulation member 242 across the stacking tray 221 (see FIG. 5).

The floating regulation member 342 is disposed at two positions in the upper portion of the side regulation member 224F that faces the side regulation member 224R having the blower ports 240 across a sheet placing surface. The floating regulation member 342 is configured to be turnable about a rotation axis 342*a* provided to the side regulation member 224F and protrudes above the sheet P so as to regulate floating of the sheet P abutting against the side regulation member 224F. With this configuration, the sheet P blown by the air fed through the blower ports 240 and thus be floated abuts against the floating regulation member 342 to be prevented from being floated higher than the position of the floating regulation member 342. Thus, a sufficient amount of air is fed between sheets and, whereby, the sheet P is regulated to an adequate position where it can be separated from the lower sheet and properly fed, thus preventing multi-feed.

Figure 10:
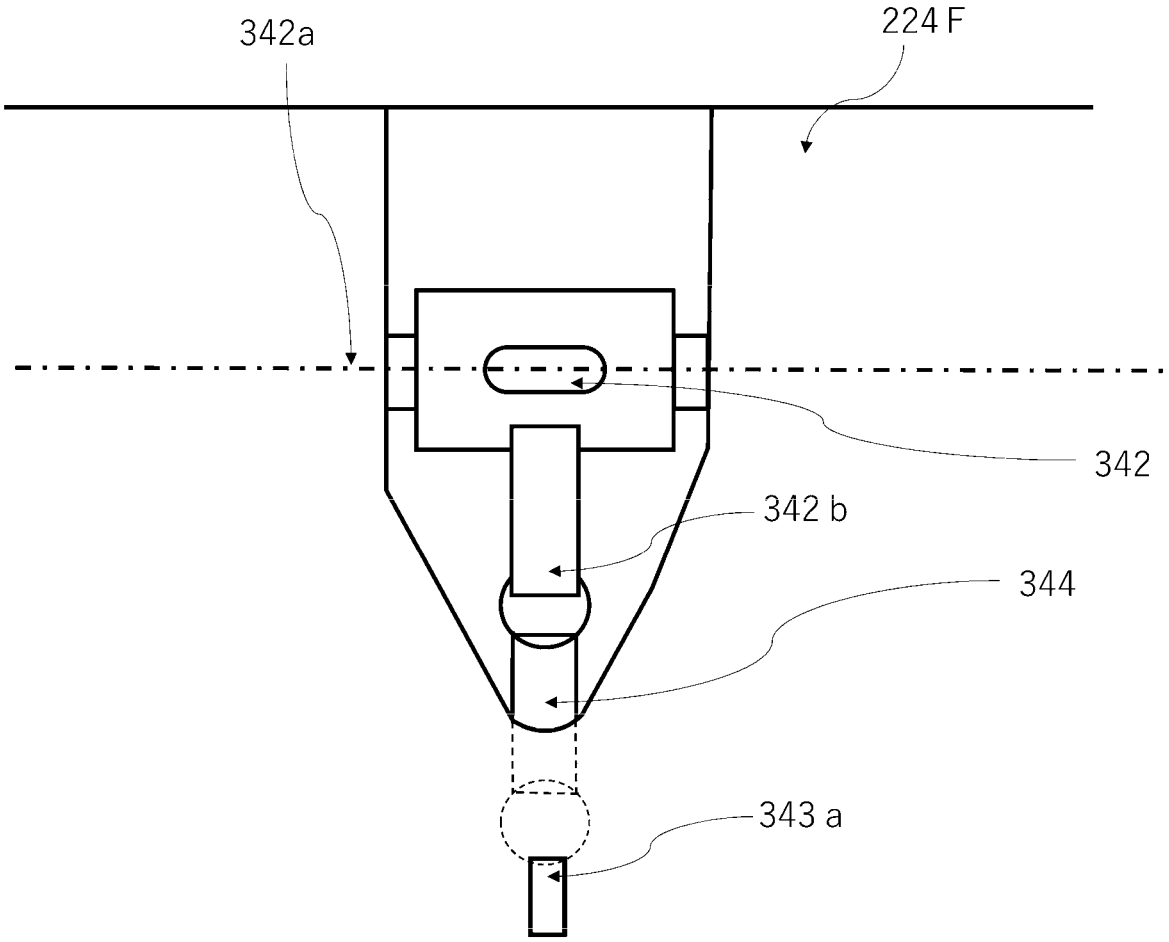
FIG. 10 is a schematic view illustrating an attachment state of a front-side floating regulation member.

The floating regulation member 342 will be described in more detail. As illustrated in FIG. 10, the floating regulation member 342 is configured to be turnable about the rotation axis 342*a*. The floating regulation member 342 is attached with an elastic member 344 for maintaining the angle of the floating regulation member 342 by pulling the floating regulation member 342 downward of the rotation axis 342*a*. As the elastic member 344, a tension spring is used. One end of the tension spring is attached to an attachment part 342*b* provided immediately below the rotation axis 342*a*, and the other end thereof is attached to an attachment part 343*a* fixed to the side regulation member. The floating regulation member 342 rotates clockwise about the rotation axis 342*a* by its own weight in the absence of the elastic member 344. The elastic member 344 applies a tensile force to the floating regulation member 342 to hold the floating regulation member 342 at a floating regulation position as illustrated in FIG. 10.

Figure 11:
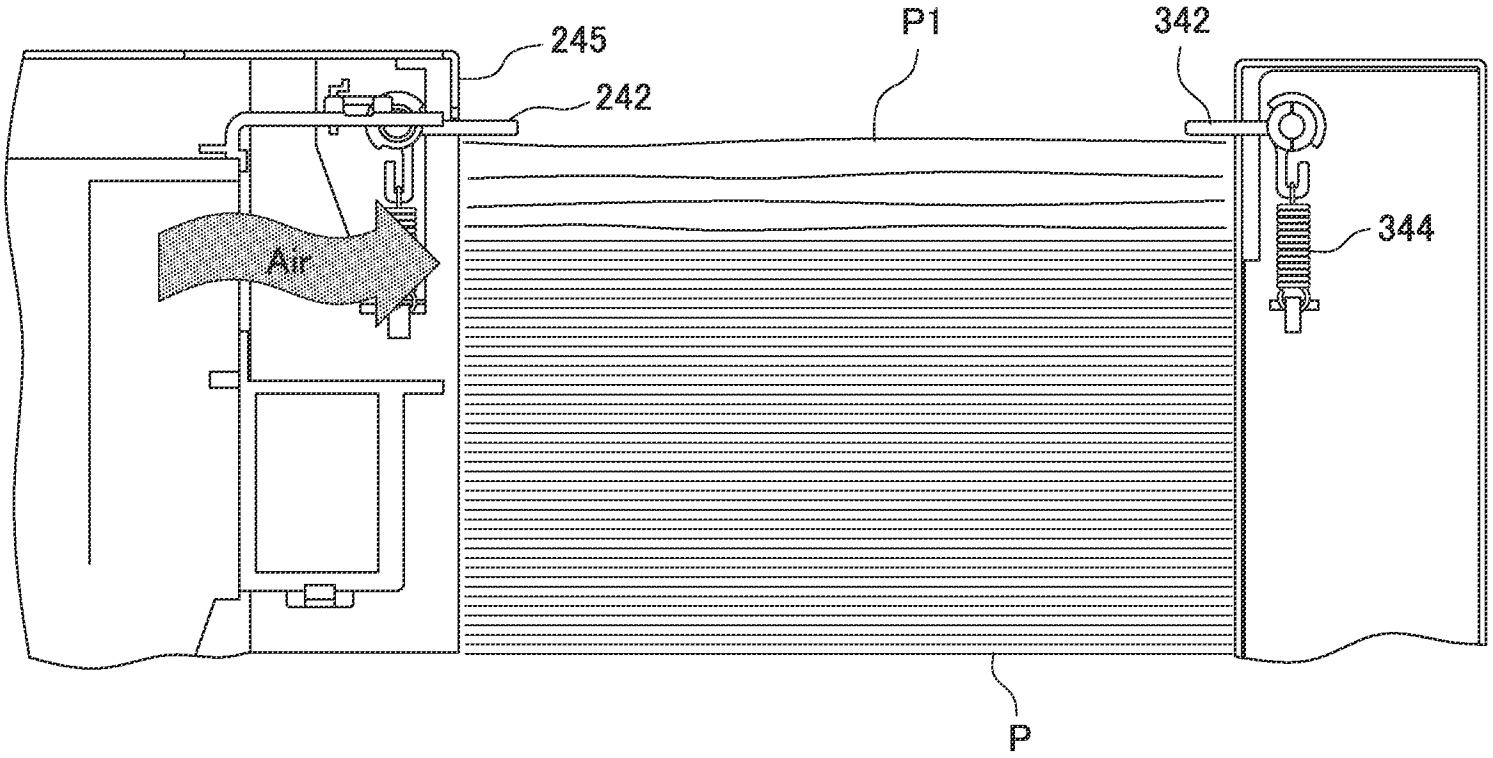
FIG. 11 is an explanatory view of an arrangement of the rear-side floating regulation member and front-side floating regulation member as viewed in the conveyance direction of sheets stored in a storage part.

As illustrated in FIG. 11, the floating regulation member 342 is positioned away from the blower ports 240 across the sheet bundle, so that a part of the sheet bundle on the floating regulation member 342 side is less affected by air blowing. Therefore, the floating regulation member 342 does not have a configuration of regulating the upward turning like the turning regulation guide 245 for the floating regulation member 242. Thus, the floating regulation member 342 is positioned so as to hold the sheet P1 floated by the air blowing only by the force of the elastic member 344.

When a user takes out the sheet bundle without widening the space between the front-side side regulation member 224F and the rear-side side regulation member 224R, the sheet bundle pushes upward the floating regulation members 242 and 342. Specifically, the floating regulation member 242 abuts against the slope part S of the turning regulation guide 245 and is turned upward along the slope, while a load to be applied to the floating regulation member 342 is substantially the same between when the floating regulation member 342 is turned upward and when it is turned downward. That is, at the time of taking out the sheet bundle, a load against the upward turning of the floating regulation member 342 provided on the front side is smaller than a load against the upward turning of the floating regulation member 242 regulated by the turning regulation guide 245.

When the user lifts the sheet bundle at the time of taking out the sheet bundle, a larger force acts on a part of the sheet bundle on the floating regulation member 342 side (front side) which is the near side as viewed from the user than on a part of the sheet bundle on the floating regulation member 242 side (rear side); however, since a load against the upward turning of the floating regulation member 342 is small, the sheet bundle is applied with a small load and is thus not damaged. On the other hand, the sheet bundle is taken out from the front side with the front side thereof lifted. It follows that the rear side of the sheet bundle is less likely to be lifted, and thus, a load applied to a part of the sheet bundle on the rear side at the time of taking out the sheet bundle is small.

As described above, the rear-side floating regulation member 242 and the front-side floating regulation member 342 have different loads against the upward turning, whereby the sheet can be easily taken out without being damaged due to interference with the floating regulation members 242 and 342.

Although the sheet is directly subject to air blowing from the blower unit on the rear side close to the blower ports 240, the turning regulation guide 245 effectively regulates the floating of the sheet.

Further, in the present embodiment, in a single storage part, four floating regulation members are provided on the rear side, while two floating regulation members are provided on the front side. With this configuration, a part of the sheet bundle that is close to the blower ports 240 is strongly held, and the sheet bundle can easily be taken out without interference with the floating regulation members.

The floating regulation member 242 according to the present invention may be configured to be turnable upward with a certain load without being completely fixed. In this case, the user can take out the sheet bundle more easily. Further, when a lifter is moved upward in a state where, for example, a foreign matter is left behind in the sheet placing part, breakage of the apparatus can be prevented.

In the present embodiment, the floating regulation member 242 is positioned by means of the spring, and only the upward turning thereof is regulated by the stopper. Other than the above, the following configurations may be adopted, for example: a drive source is provided for the turning part, and the output thereof is changed between when the floating regulation member 242 is turned upward and when it is turned downward; or a lever biased by a spring is used as the turning regulation member for the floating regulation member to hold down the floating regulation member.

In addition, this application claims priority from Japanese Patent Application No. 2020-112394 incorporated herein by reference.

The invention claimed is:

1. A sheet storage apparatus comprising:

a storage part for stacking and storing sheets;

a pair of first and second side regulation members for regulating both end portions of the sheets stored in the storage part;

a sheet feed part for conveying the sheets stored in the storage part in a predetermined conveyance direction;

a blower unit provided to the first side regulation member and configured to blow air to one end portion of the sheets stored in the storage part to loosen the sheets;

a floating regulation member provided to the first side regulation member and configured to regulate a height of the sheet floated by the air fed by the blower unit, wherein the floating regulation member is provided so as to be turnable in a sheet stacking direction about a rotation axis provided to the first side regulation member, and a load applied to the floating regulation member differs between when the floating regulation member is turned upward and when it is turned downward;

an elastic member for defining a position of the floating regulation member in its turning direction; and a turning regulation guide for regulating the position of the floating regulation member, wherein when the floating regulation member is turned downward, it is held by a holding force of the elastic member, and when the floating regulation member is turned upward, an upward turning of the floating regulation member is regulated by the turning regulation guide together with the elastic member until a predetermined load is applied.

2. The sheet storage apparatus according to claim 1, wherein the turning regulation guide has a slope part contacting the floating regulation member, and when the floating regulation member is turned upward to cause an overload, the floating regulation member is slid along the slope part in the conveyance direction.

3. A sheet storage apparatus comprising:

a storage part for stacking and storing sheets;

a pair of first and second side regulation members for regulating both end portions of the sheets stored in the storage part;

a sheet feed part for conveying the sheets stored in the storage part in a predetermined conveyance direction;

a blower unit provided to the first side regulation member and configured to blow air to one end portion of the sheets stored in the storage part to loosen the sheets; and floating regulation members provided respectively to the first and second side regulation members and configured to regulate a height of the sheet floated by the air fed by the blower unit, wherein the floating regulation members are provided on an apparatus far side and an apparatus near side of the storage part so as to be turnable in a sheet stacking direction about rotation axes provided respectively on the first and second side regulation members, a load applied to the floating regulation member when the floating regulation member is turned upward is different between the floating regulation member on the far side and the floating regulation member on the near side, and the load when the floating regulation member on the far side is turned upward is greater than the load when the floating regulation member on the near side is turned upward.

4. The sheet storage apparatus according to claim 3, wherein the blower unit is provided on the apparatus far side of the storage part, and the floating regulation members are provided on the apparatus far side of the storage part.

* * * * *